United States Patent [19]

Thomas et al.

[11] Patent Number: 4,648,521

[45] Date of Patent: Mar. 10, 1987

[54] COMPOSITE METAL AND PLASTIC TANK

[75] Inventors: Larry D. Thomas; David L. Waltke; Gary Gibson, all of Beatrice, Nebr.

[73] Assignee: Hoover Group, Inc., Roswell, Ga.

[21] Appl. No.: 867,120

[22] Filed: May 27, 1986

[51] Int. Cl.[4] ..... B65D 87/00

[52] U.S. Cl. ..... 220/1.5; 220/1 B; 220/5 A

[58] Field of Search ..... 220/1.5, 1 B, 5 A, 401

[56] References Cited

U.S. PATENT DOCUMENTS

| | | | |
|---|---|---|---|
| 2,271,660 | 2/1942 | Norbom | 220/1.5 X |
| 2,457,841 | 1/1949 | Smith et al. | 220/1.5 |
| 2,887,251 | 5/1959 | Mackridge | 220/1.5 X |
| 3,344,831 | 10/1967 | Brackett | 220/1.5 X |
| 3,814,290 | 6/1974 | Gerhard | 220/5 A X |
| 4,157,609 | 6/1979 | Schutz | 220/1.5 X |
| 4,173,288 | 11/1979 | Schutz | 220/1.5 X |

*Primary Examiner*—Steven M. Pollard

*Attorney, Agent, or Firm*—Stephenson and Boller

[57] ABSTRACT

A composite metal and plastic tank consisting of a metal frame assembly with a replaceable hollow plastic container mounted therein. The plastic container has downwardly inclined flow channels formed in its base to insure complete drainage of the container when desired and the bottom wall of the frame assembly is flat to enable handling of the tank with conventional fork lift equipment. A comprehensive dunnage plate is interposed in the frame assembly between the container base and the frame bottom wall.

2 Claims, 4 Drawing Figures

COMPOSITE METAL AND PLASTIC TANK

BACKGROUND OF THE INVENTION

In the field of storing and transporting bulk liquid material, there has been a long-standing need for a composite plastic and metal tank in which:

(1) The composite tank is constructed so that the plastic bottle therein is replaceable;

(2) The plastic bottle can be fully emptied with the tank in an upright position; and (3) The bottom wall of the metal frame for the composite tank is positioned so that it is engageable with the tine of a conventional fork lift.

It is the principal object of this invention, therefore, to provide an improved composite metal and plastic tank which accomplishes the above described objectives.

SUMMARY OF THE INVENTION

A composite metal and plastic tank consisting of a metal frame assembly and a plastic bottle supported therein. The metal frame has a substantially horizontal flat bottom member of rectangular shape mounted on supporting legs and an open metal framework extending upwardly from the bottom member and terminating in a top frame member that is aligned with the bottom member.

The plastic bottle is supported on the metal frame assembly and is of a size to extend upwardly from the frame bottom member to the top frame member in close proximity to the open framework at positions between the top and bottom members. The bottle has a base provided with a discharge opening and a discharge spout which extends downwardly from the base in communication with the discharge opening and through an opening formed in the metal bottom member on which the plastic bottle rests. The base of the bottle has downwardly inclined flow channels formed in it which terminate at the discharge opening to insure complete drainage of the bottle, when desired, without requiring tipping or inversion of the tank. Importantly, a dunnage plate supported on the frame bottom member at a position below the bottle base is formed of a foam material that is cut away to accommodate the inclined flow channels in the bottle base in varying amounts thereby enabling the container to be firmly supported on the frame assembly in an upright position with the frame bottom member being substantially horizontal to enable handling of the composite tank assembly with conventional fork lift equipment.

The plastic bottle can be removed from the framework and replaced when desired and can be fully emptied with the tank in an upright position by virtue of the inclined flow channels formed in the base of the bottle and terminating at the discharge opening. The bottom wall of the frame assembly is flat and horizontal to enable lifting engagement of the composite tank with a conventional fork lift tine.

Further objects, features and advantages of the invention will become apparent from a consideration of the following description, the appended claims and the accompanying drawing in which:

Figure 1:
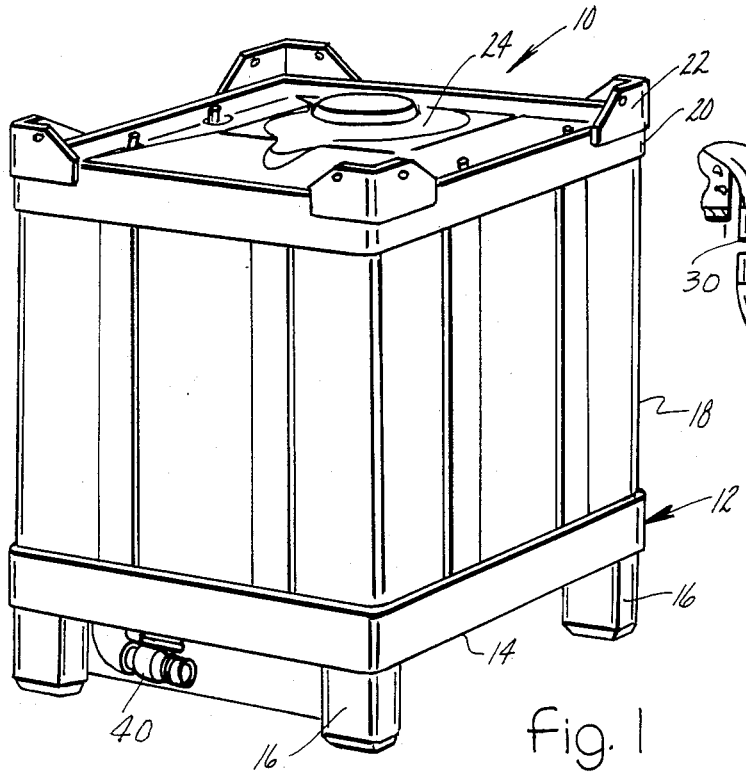
FIG. 1 is a perspective view of the composite tank of this invention.

With reference to the drawing, the composite metal and plastic tank of this invention, indicated generally at 10, is illustrated in FIG. 1 as including a metal frame assembly 12 having a substantially horizontal flat bottom member 14, supported on legs 16. When they are floor supported, the legs 16 position the bottom member 14 above the floor a distance sufficient to enable engagement of the bottom member 14 with conventional fork lift equipment. An open metal framework 18 extends upwardly from the bottom member 14 and terminates in a rectangular top frame member 20. Combination lifting lugs and leg positioners 22 are secured to the top frame member 20 at the corners thereof.

A hollow plastic bottle or container 24 is supported on and positioned within the metal frame assembly 12 as shown in FIG. 1. The bottle 24 is supported on the bottom member 14 at a position within the framework 18 and is of a size to extend upwardly from the frame bottom member to the top frame member 20 in close proximity to the framework 18 at positions therebetween. The container 34 has a base 26 (FIGS. 2 and 3) provided with a discharge opening 28 and a discharge spout 30 which communicates with the discharge opening 28 and extends downwardly therefrom. The frame bottom member 14 has an opening 34 through which the spout 30 extends downwardly.

The base 26 has downwardly inclined flow channels 36 formed therein which extend below the base 26 and terminate at the discharge opening 28 to ensure complete drainage of the bottle 24 when in an upright position.

Figure 2:
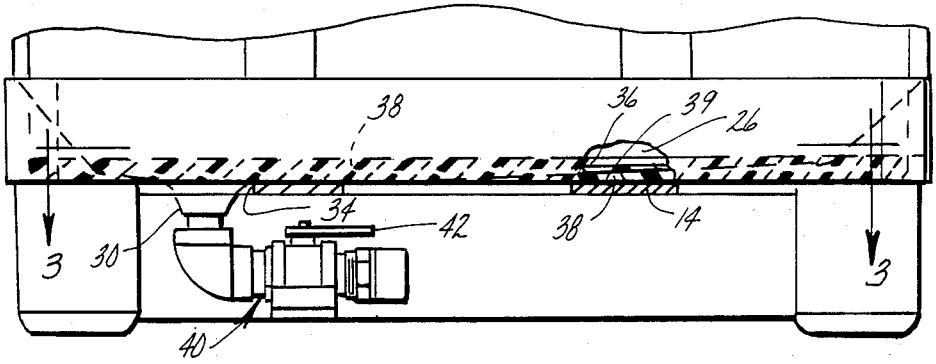
FIG. 2 is a foreshortened elevational view of a bottom portion of the composite tank, with some parts broken away and other parts shown in section for the purpose of clarity.
Figure 3:
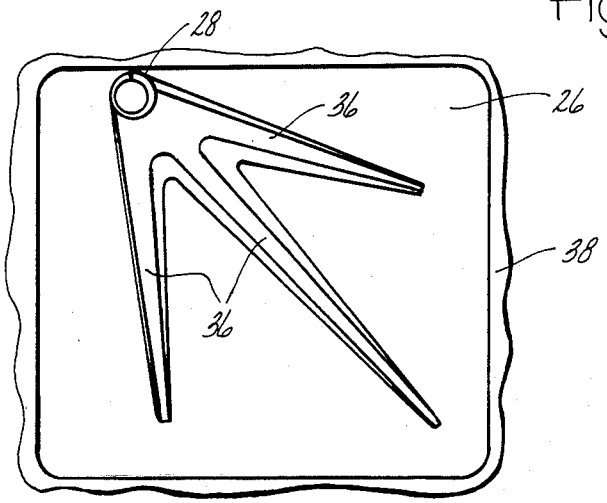
FIG. 3 is a fragmentary view of the base of the plastic bottle in the composite tank of this invention, showing the inclined flow channels formed therein, as seen from substantially the line 3—3 in FIG. 2.

A dunnage plate 38, formed of a foam material and supported on the frame bottom member 14 at a position below the container base 26, as shown in FIG. 2, is cut away to form openings 39 to accommodate the flow channels 36 to enable support of the bottle 24 in an upright position within the frame 12. In other words, the downwardly inclined channels 36 will extend downwardly into the plate 38 to enable the inclined base 26 of the container 24 to be set down flat on the dunnage plate 38. The dunnage plate 38 thus accommodates the inclined container channels 36 with respect to the flat frame bottom member 14 to enable complete drainage of the bottle 24 without tipping, and handling of the container 10 with conventional fork lift equipment engaging the bottom member 14.

Figure 4:
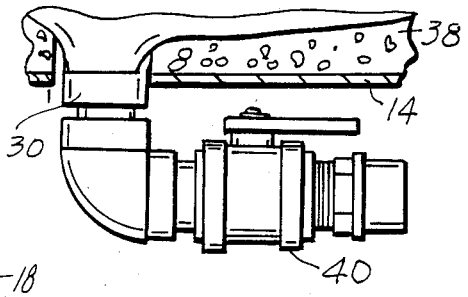
FIG. 4 is an enlarged fragmentary sectional view of the discharge portion of the composite tank of this invention.

As shown in FIGS. 1, 2 and 4, a discharge valve assembly 40 is connected to the discharge spout 30 and located in the space below the bottom member 14 to enable selective discharge of material from the bottle 24 by manipulation of a manually operable handle 42.

From the above description, it is seen that this invention provides a composite metal and plastic tank 10 that includes a replaceable bottle 24 that is mounted in an upright position within a frame assembly 12. The bottle 24 can be fully emptied by virtue of the flow channels 36 that are inclined downwardly and terminate at the discharge opening 28 while still enabling the bottom member 14 on the frame assembly 12 to be disposed in a horizontal position so that the composite tank can be handled with conventional fork lift equipment. These advantages are obtained by virtue of the inclusion of the foam dunnage plate 38 between the frame bottom member 14 and the base 26 of the bottle 24.

What is claimed is:

1. A composite metal and plastic tank comprising a metal frame assembly having a substantially horizontal flat bottom member of rectangular shape, supporting legs for said bottom member depending therefrom, an open framework extending upwardly from said bottom member and terminating in a rectangular top frame member, combination lifting lugs and leg positioners at the corners of said top frame, a hollow plastic container supported on said frame, said container being supported on said bottom member at a position within said framework and being of a size to extend upwardly from said frame bottom member to said top frame member in close proximity to said framework at positions therebetween, said container having a base provided with a discharge opening and a discharge spout extending downwardly from said base in communication with said discharge opening, said frame bottom member having an opening through which said spout extends downwardly, said base having downwardly inclined flow channels formed therein and terminating at said discharge opening to insure complete drainage of said container when desired, a dunnage plate formed of a foam material and supported on said frame bottom member at a position below said container base, said dunnage plate being provided with openings to accommodate the inclined portions of said base to thereby enable said container to be firmly supported on said frame assembly in an upright position with said frame bottom member being substantially horizontal to enable handling of said composite tank with conventional fork lift equipment.

2. A composite metal and plastic tank comprising a metal frame assembly having a substantially horizontal flat bottom member of rectangular shape, an open framework extending upwardly from said bottom member and terminating in a rectangular top frame member, a hollow plastic container supported on said frame, said container being supported on said bottom member at a position within said framework and being of a size to extend upwardly from said frame bottom member to said top frame member in close proximity to said framework at positions therebetween, said container having a base provided with a discharge opening, said base having downwardly inclined flow channels formed therein and terminating at said discharge opening to insure complete drainage of said container when desired, and dunnage means supported on said frame bottom member at a position below said container base enabling said container to be firmly supported on said frame assembly in an upright position with said frame bottom member being substantially horizontal to enable handling of said composite tank with conventional fork lift equipment.

* * * * *